US009105168B2

(12) United States Patent
Shute et al.

(10) Patent No.: US 9,105,168 B2
(45) Date of Patent: Aug. 11, 2015

(54) METHOD AND APPARATUS FOR SECURING RELATED PRODUCTS

(75) Inventors: Matthew R. Shute, Huntersville, NC (US); Mark A. Ezzo, Matthews, NC (US)

(73) Assignee: Checkpoint Systems, Inc., Thorofare, NJ (US)

( * ) Notice: Subject to any disclaimer, the term of this patent is extended or adjusted under 35 U.S.C. 154(b) by 255 days.

(21) Appl. No.: 13/414,249

(22) Filed: Mar. 7, 2012

(65) Prior Publication Data

US 2012/0227446 A1 Sep. 13, 2012

Related U.S. Application Data

(60) Provisional application No. 61/450,939, filed on Mar. 9, 2011.

(51) Int. Cl.

| | |
|---|---|
| ***E05B 73/00*** | (2006.01) |
| ***G08B 13/02*** | (2006.01) |
| ***G08B 13/14*** | (2006.01) |
| ***E05B 45/00*** | (2006.01) |

(52) U.S. Cl.

CPC ..... *G08B 13/1445* (2013.01); *E05B 45/005* (2013.01); *E05B 73/0005* (2013.01); *E05B 73/0029* (2013.01); *E05B 73/0082* (2013.01); *G08B 13/1463* (2013.01); *Y10T 29/49764* (2015.01); *Y10T 70/402* (2015.04)

(58) Field of Classification Search

CPC ..... E05B 73/02; E05B 45/005; E05B 45/006; E05B 67/003; E05B 67/22; E05B 67/24; E05B 71/00; E05B 73/0005; E05B 73/0017; E05B 73/0052; E05B 73/007; E05B 73/0029; E05B 73/0041; E05B 73/0047; E05B 73/0064; E05B 73/0082; E05B 73/0094; B23P 11/00; G08B 13/12; G08B 13/122; G08B 13/14; G08B 13/1409; G08B 13/1445; G08B 13/1463; G08B 13/1472; G08B 13/2434; A45C 13/18; A47F 7/024; B62H 5/003; B62H 5/00; B62H 5/20; G06F 21/88; G09F 3/0352; Y10T 29/49764; Y10T 70/402

USPC ..... 70/14, 15, 19, 25, 30, 49, 57.1, 58, 233, 70/235; 248/551, 552, 553; 340/427, 340/568.1, 568.2, 568.4, 568.6, 568.8, 571, 340/572.1, 572.9

See application file for complete search history.

(56) References Cited

U.S. PATENT DOCUMENTS

| | | | | |
|---|---|---|---|---|
| 4,037,441 | A | 7/1977 | Ray | |
| 5,791,170 | A * | 8/1998 | Officer | 70/49 |
| 6,474,121 | B2 * | 11/2002 | Sakai et al. | 70/276 |
| 6,578,394 | B2 * | 6/2003 | Yin | 70/58 |
| 7,446,659 | B2 * | 11/2008 | Marsilio et al. | 340/568.1 |

(Continued)

*Primary Examiner* — Benjamin C Lee
*Assistant Examiner* — Stephen Burgdorf
(74) *Attorney, Agent, or Firm* — Richard A. Howe, II

(57) ABSTRACT

This invention relates to a tether device for use in a retail environment in conjunction with a cable lock security device. The cable lock device includes a cable having a free end which extends outwardly away therefrom after the cable lock is secured onto an article of goods. The tether is configured to receive the free end inside a lock channel alternatively lock and unlock this free end with the tether. The tether is intended to be secured onto a separable portion of an article of goods, while the cable lock is intended to be secured onto another separable portion. Thus, in locking the cable lock and the tether together, the two separable portions of the article of goods are thereby rendered generally inseparable.

15 Claims, 13 Drawing Sheets

(56) References Cited

U.S. PATENT DOCUMENTS

| | | | | |
|---|---|---|---|---|
| 7,453,370 | B2 * | 11/2008 | Marsilio et al. | 340/686.1 |
| 7,808,382 | B2 * | 10/2010 | Bonato | 340/568.2 |
| 8,122,744 | B2 * | 2/2012 | Conti et al. | 70/57.1 |
| 8,297,086 | B2 * | 10/2012 | Yu et al. | 70/14 |
| 8,665,095 | B2 * | 3/2014 | Yang | 340/572.8 |
| 2004/0154358 | A1 | 8/2004 | Yu | |
| 2006/0075794 | A1 * | 4/2006 | Ling et al. | 70/58 |
| 2006/0170549 | A1 | 8/2006 | Belden, Jr. et al. | |
| 2006/0196780 | A1 * | 9/2006 | Horngren | 206/1.5 |
| 2007/0171061 | A1 | 7/2007 | Belden et al. | |
| 2007/0245778 | A1 * | 10/2007 | Lu | 70/58 |
| 2008/0148789 | A1 * | 6/2008 | Wyers | 70/49 |
| 2008/0190931 | A1 | 8/2008 | Perlman et al. | |
| 2008/0266111 | A1 * | 10/2008 | Shute et al. | 340/572.9 |
| 2008/0316028 | A1 * | 12/2008 | Conti et al. | 340/568.2 |
| 2009/0303046 | A1 | 12/2009 | Eckert et al. | |
| 2010/0307204 | A1 | 12/2010 | Yu | |
| 2013/0067967 | A1 * | 3/2013 | Olear et al. | 70/18 |

* cited by examiner

METHOD AND APPARATUS FOR SECURING RELATED PRODUCTS

CROSS-REFERENCE TO RELATED APPLICATION

This application claims priority from U.S. Provisional Application Ser. No. 61/450,939 filed Mar. 9, 2011, the disclosure of which is incorporated herein by reference.

BACKGROUND OF THE INVENTION

1. Technical Field

This invention relates to anti-theft security devices. More particularly, this invention relates to a tether device for attachment to an end of a cable, wherein the cable is an element of a cable lock security device. Specifically, this invention relates to securing a tether device to a separable part of an article of goods, securing a cable lock security device to a different separable part of the article of goods, and locking an end of a cable extending from the cable lock security device to the tether to secure both parts of the article of goods.

2. Background Information

Various retail establishments use numerous types of theft deterrent systems and devices to discourage shoplifting. Many of these devices attach to the article to be protected by cables which wrap around the device or extend through portions of the device or are secured thereto in other manners. The cable lock security device will sound an alarm if the security device itself is tampered with, such as cutting the attachment cable. Also, the security device will carry an EAS tag which will actuate an alarm of a security gate that is usually located at the exit of the retail establishment. These security devices contain an alarm system which includes an audible alarm which emits a high pitched alarm sound through a speaker, such as a piezoelectric speaker, mounted in the security device. The alarm alerts store personnel that the article being protected thereby is being tampered with, as well as possible tampering of the security device itself.

While these cable lock-style security devices are extremely useful for securing monolithic one-piece articles such as leather jackets, there exists a class of articles which are generally comprised of two main portions which are removably secured together. Each portion is separately valuable in the market, thus a shoplifter need only separate and remove one of the portions to shoplift a valuable item. For example, a cordless drill typically includes a drill portion and a battery portion removably secured thereto, wherein both portions are separately valuable. If a standard style cable lock security device is secured to the drill portion around the handle, a shoplifter could disconnect the battery portion and steal only this unsecured portion, leaving the secured drill portion behind. A retail seller of the cordless drill may attempt to protect both portions. However, this necessitates securing a cable lock security device to both portions of the article, thus requiring twice the inventory of cable lock security devices. Inasmuch as these security devices represent a non-trivial expense to a retail seller and require time during check-out to remove, most sellers do not apply more than one cable lock security device to a particular article.

Thus, the need exists for a companion device such as a tether for use in combination with a cable lock security device, whereby the tether facilitates securing both portions of an article together, and whereby the tether device itself is secured to the cable lock security device. The tether needs to be inexpensive, such that a retail seller would incur a minimal cost to upgrade the existing cable lock style inventory to protect both portions of an article of goods. Furthermore, the tether may incorporate features which allow for locking and unlocking a portion of the cable lock device to the tether, preferably through a locking engagement with a free end of a cable used in the cable lock security device. Inasmuch as a key may be required to unlock the cable lock security device, the same key should also be used to unlock the tether. Alternatively, a new cable lock security device may be provided which includes an end of the cable secured to the cable lock and the other end permanently secured to the tether. In this embodiment, a sensor may be disposed in the tether to inform the cable lock via a circuit when the tether has been removed from the second article.

BRIEF SUMMARY OF THE INVENTION

This invention relates to a tether device for use in a retail environment in conjunction with a cable lock security device. One embodiment of this invention is directed to a cable lock device which includes a cable having a free end which extends outwardly away therefrom after the cable lock is secured onto an article of goods. The tether is configured to receive the free end inside a lock channel alternatively lock and unlock this free end with the tether. The tether is intended to be secured onto a separable portion of an article of goods, such as a battery portion of a cordless drill, while the cable lock is intended to be secured onto another separable portion, such as the drill portion of the cordless drill. Thus, in locking the cable lock and the tether together, the two separable portions of the article of goods are thereby rendered generally inseparable. Therefore, a shop-lifter can no longer separate an article of goods and steal an unsecured portion. Furthermore, inasmuch as the cable lock security device typically incorporates advanced anti-theft technology, in securing the tether to the cable lock device, the separable portion is thereby connected to the cable lock through intermediate elements, namely the tether and the cable. Another embodiment of the present invention is directed to a cable lock with the tether permanently secured to one end of the cable. This embodiment may further include a sensor disposed in the tether for sensing when the tether is removed from the second article. This information is then relayed to the alarm system in the cable lock which generates an alarm.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
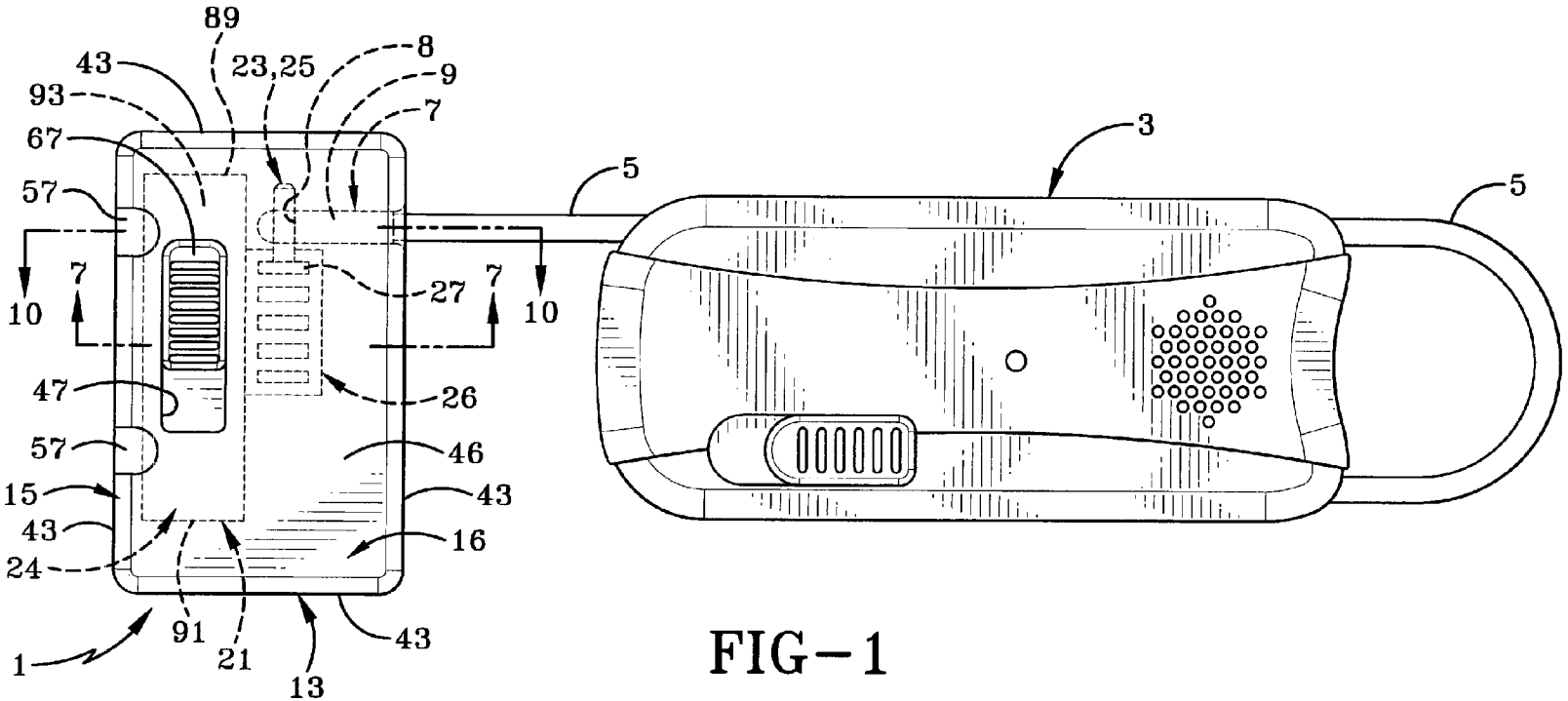
FIG. 1 is a top plan view of a first embodiment of a security device of the present invention showing a cable lock connected with a tether.
Figure 2:
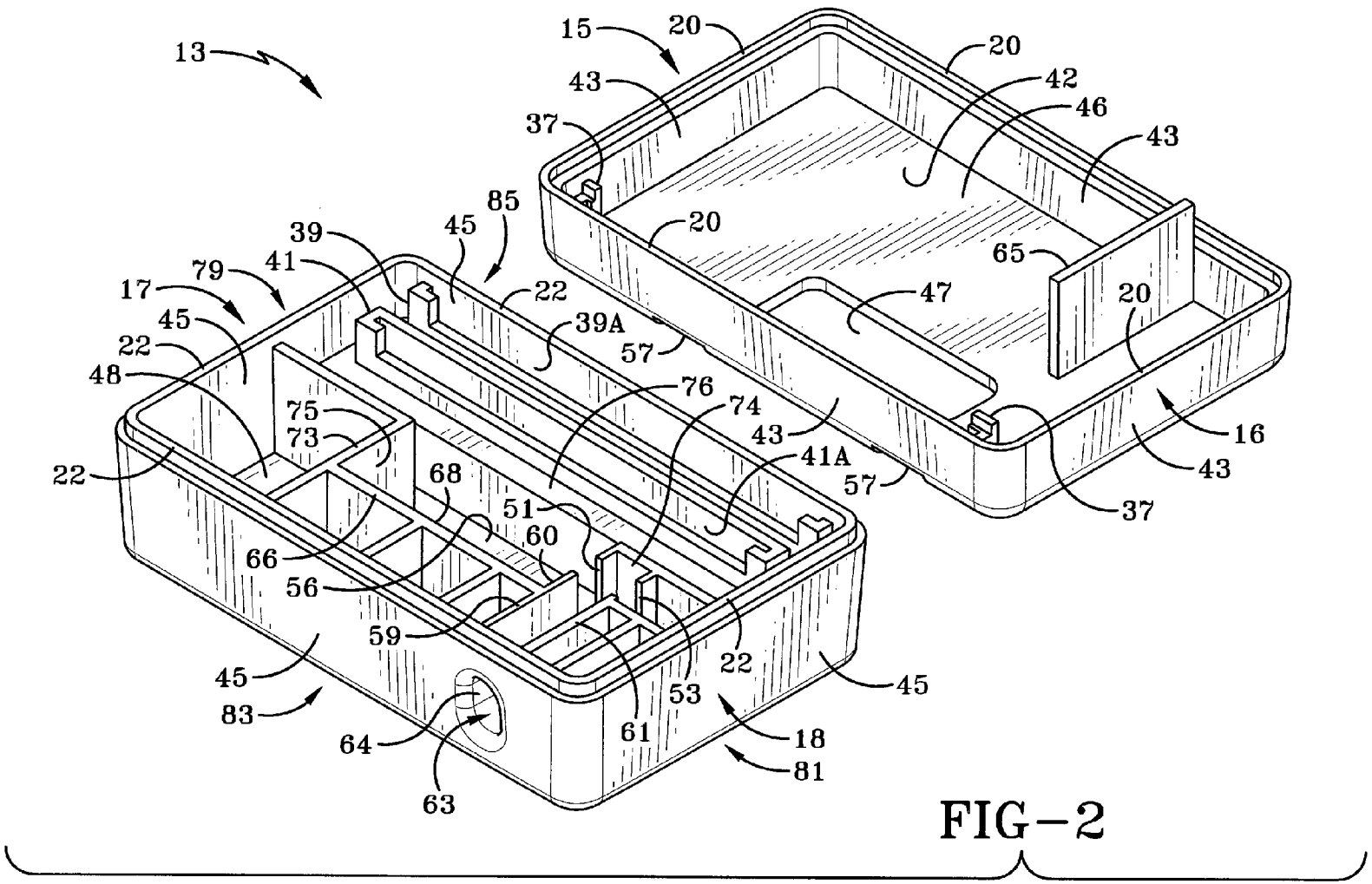
FIG. 2 is a perspective view of a top portion and a bottom portion of the tether.

A first embodiment of the security tether of the present invention is shown in FIGS. 1-12 and is indicated generally at 1. As shown in FIGS. 1 and 2, tether 1 is adapted to secure a free end 7 of a cable 5 extending from a cable lock security device 3. Free end 7 includes a crimp 9 defining a lock opening 8 therethrough, generally perpendicular to the longitudinal axis of cable 5. Cable 5 typically includes two leads 11 (FIG. 10) which allows a sense circuit to be incorporated into cable 5 and cable lock security device 3. This sense circuit actuates an alarm system when the electronic circuit facilitated by leads 11 is broken or incomplete.

Figure 3:
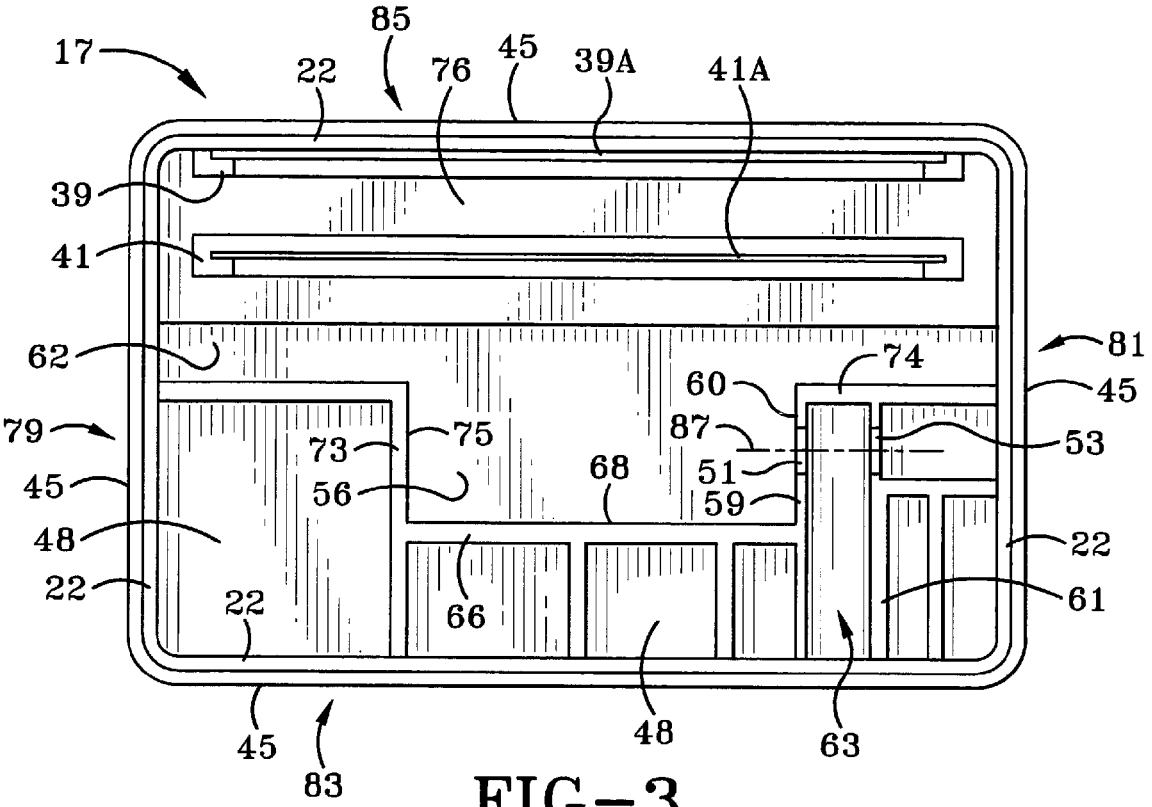
FIG. 3 is a top plan view of the bottom portion of the tether.
Figure 10:
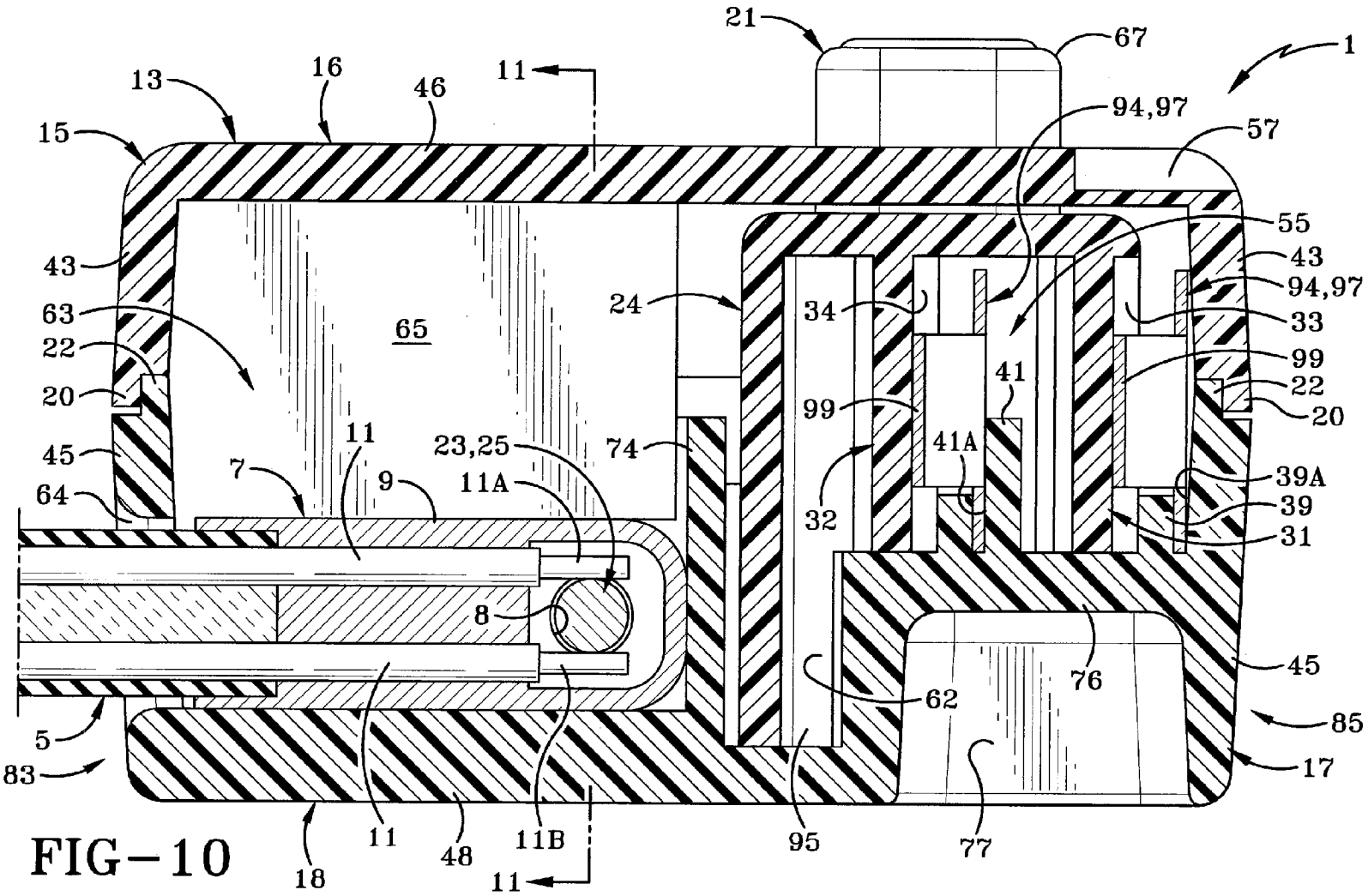
FIG. 10 is a cross-sectional view taken along line 10-10 of FIG. 1.
Figure 11:
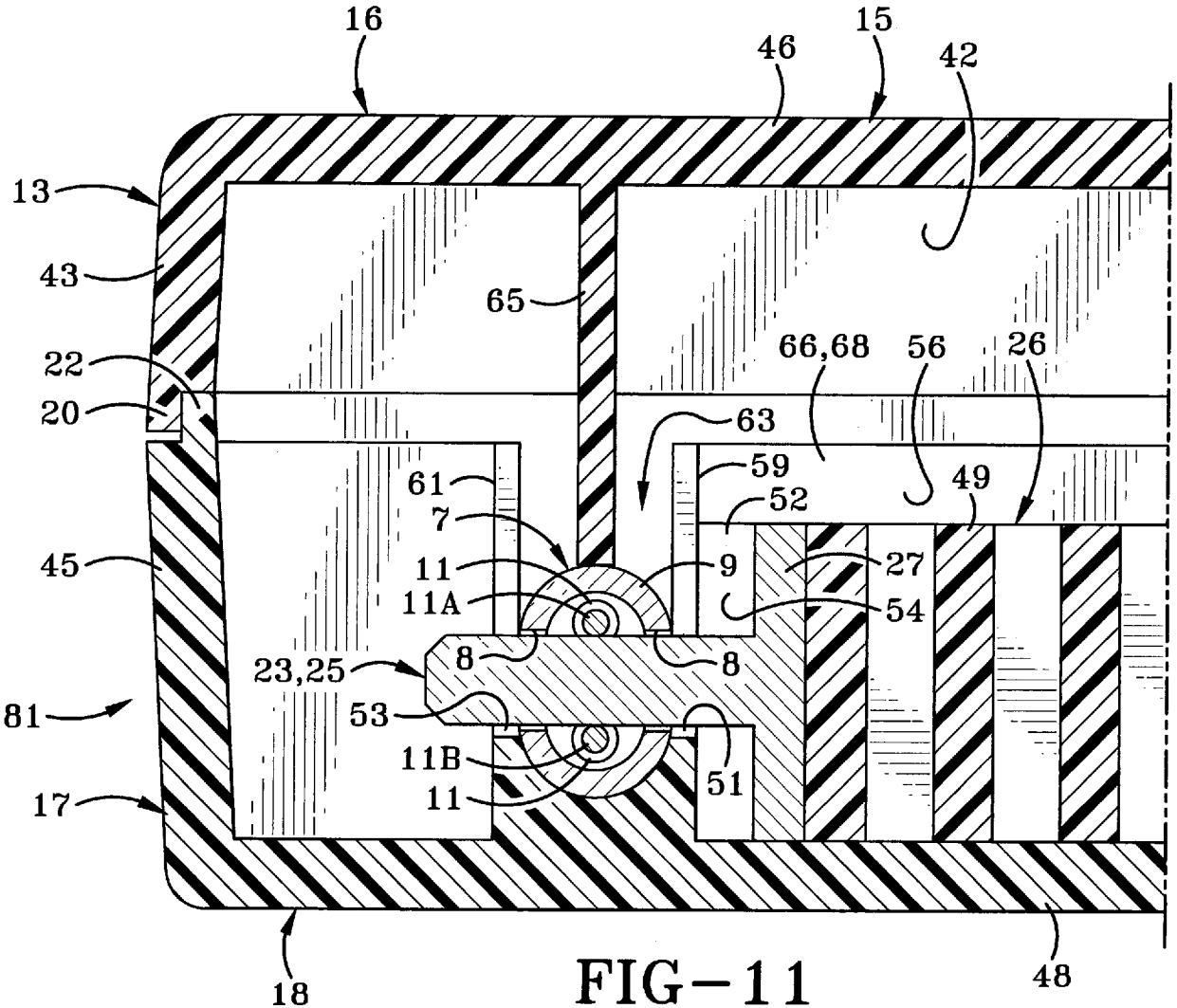
FIG. 11 is a cross-sectional view taken along line 11-11 of FIG. 10.

As shown in FIGS. 2 and 3, tether 1 is generally comprised of a housing 13 formed by a top portion 15 having an outer surface 16 and a bottom portion 17 having an outer surface 18, wherein top portion 15 and bottom portion 17 are secured together. Top portion 15 and bottom portion 17 are generally plastic molded members, each being a monolithic one-piece member cast from a single mold for top portion 15 and another single mold for bottom portion 17. In the present embodiment, top portion 15 and bottom portion 17 are sonically welded together to form housing 13. However, any method commonly known in the art for securing two plastic molded members together may be used. As shown in FIG. 10, for added security and structural stability, top portion 15 includes a peripheral offset shoulder 20 in a complimentarily alignment with a peripheral offset shoulder 22 located on bottom portion 17. Offset shoulder 20 aligns and abuts offset shoulder 22 around the entire periphery of the mating engagement between top portion 15 and bottom portion 17, thus creating a sturdy and offset locked engagement therebetween. Thus, a screwdriver or box-cutter tool commonly used by shoplifters cannot penetrate directly or linearly into housing 13 as offset shoulders 20 and 22 create two 90-degree angled turns from the exterior of housing 13 to the interior to prevent prying or cutting top portion 15 apart from bottom portion 17.

Figure 9:
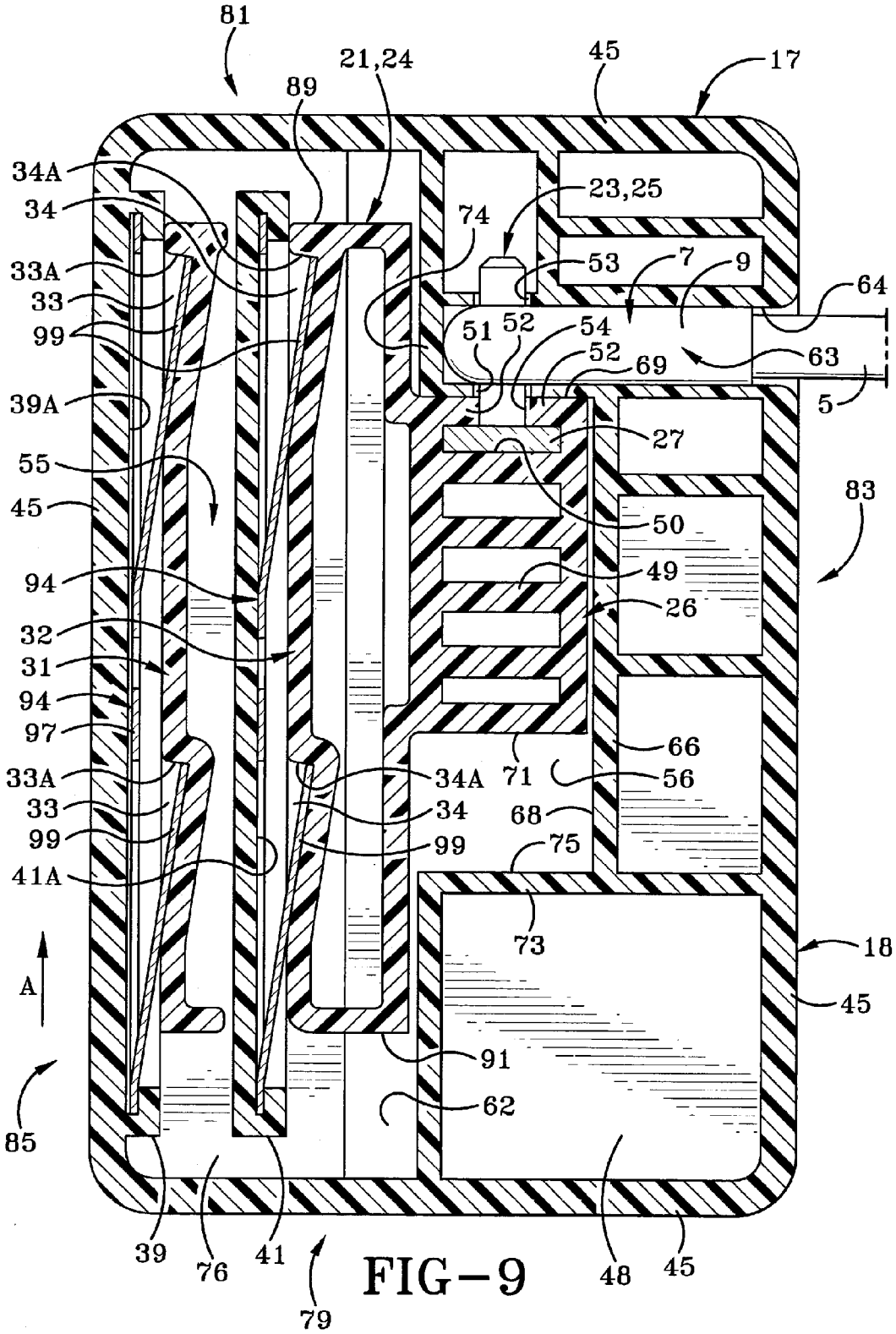
FIG. 9 is a cross-sectional view similar to FIG. 8 showing the slide element in a locked position.

As shown in FIGS. 1 and 2, top portion 15 includes an outer peripheral wall 43 surrounding a top wall 46, wherein peripheral wall 43 and top wall 46 define a cavity 42 therebetween. A brace wall 65 extends from peripheral wall 43 and top wall 46 beyond the outermost portion of peripheral wall (FIG. 9). A pair of depressions 57 are formed in top wall 46 as a discontinuity in the generally flat and smooth nature of outer surface 16. Depressions 57 are generally D-shaped and are located proximate peripheral wall 43 of bottom portion 17. Top wall 46 defines an opening 47 extending from outer surface 16 to cavity 43, and located generally proximate depressions 57.

As shown in FIGS. 2 and 3, bottom portion 17 includes an outer peripheral wall 45 surrounding a bottom wall 48. Bottom portion 17 further includes a first end 79 spaced apart from a second end 81, and a first side 83 spaced apart from a second side 85, wherein both first side 83 and second side 85 extend from first end 79 to second end 81. A longitudinal recess 77 (FIG. 7) extends from proximate first end 79 to proximate second end 81, and generally proximate second side 85. A finger recess 62 extends from proximate first end 79 to proximate second end 81. A locking plate receiving element 41 defining a slot 41A extends outwardly from a wall 76. Likewise, a locking plate receiving element 39 defining a slot 39A extends outwardly from wall 76 in a spaced parallel relationship with locking plate receiving element 41. Both locking plate receiving elements 39 and 41 extend from proximate first end 79 to proximate second end 81, and are formed in a generally elongated rectangular structure having slots 39A and 41A, respectively, defined thereby. Peripheral wall 45 defines an opening 64 proximate first side of bottom portion 17. Proximate opening 64, a first wall 59 extends parallel to a second wall 61, wherein first wall 59 and second wall 61 extend inwardly from peripheral wall 45 to a wall 75 and to define a lock channel 63 therein. First wall 59 includes a first surface 60 and defines a first bolt opening 51 therethrough and second wall 61 defines a second bolt opening 53 therethrough, wherein both first bolt opening 51 and second bolt opening 53 are aligned to define an imaginary center line 87 extending perpendicularly to channel 63. Bottom portion 17 includes a back wall 73 which defines a back surface 75. An intermediate wall 66 extends from first wall 59 to back wall 73, wherein an intermediate surface 68 extends from front surface 60 to back surface 75. Front surface 60, back surface 75, and intermediate surface 68 define a slide chamber 56 therebetween.

Figure 4:
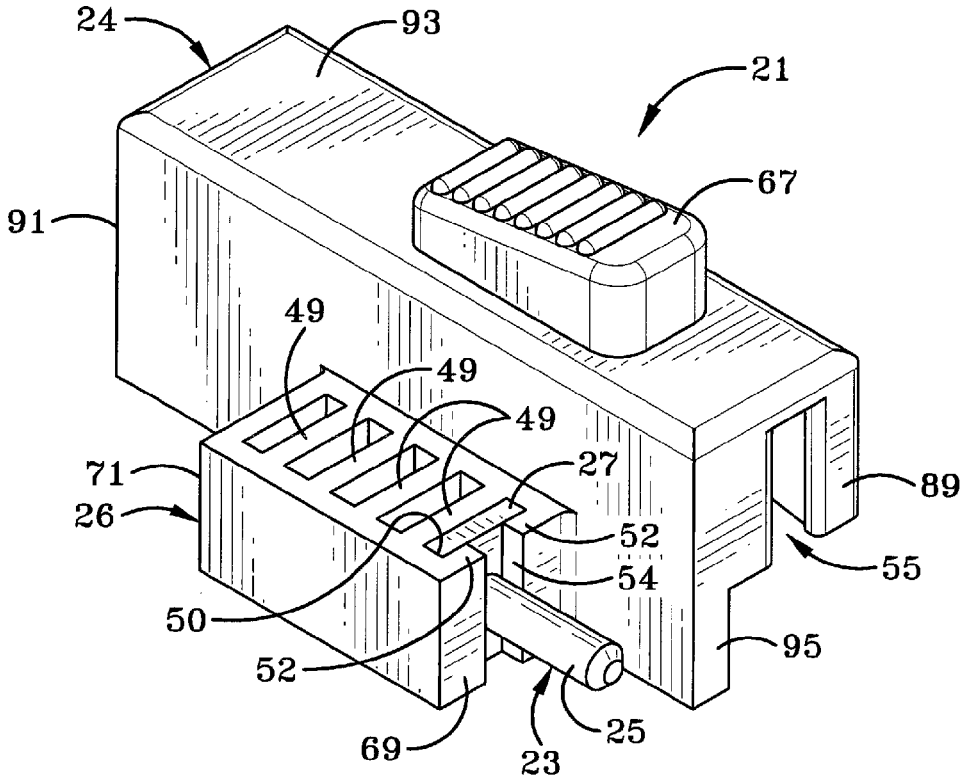
FIG. 4 is a perspective view of a slide element used in the tether.
Figure 5:
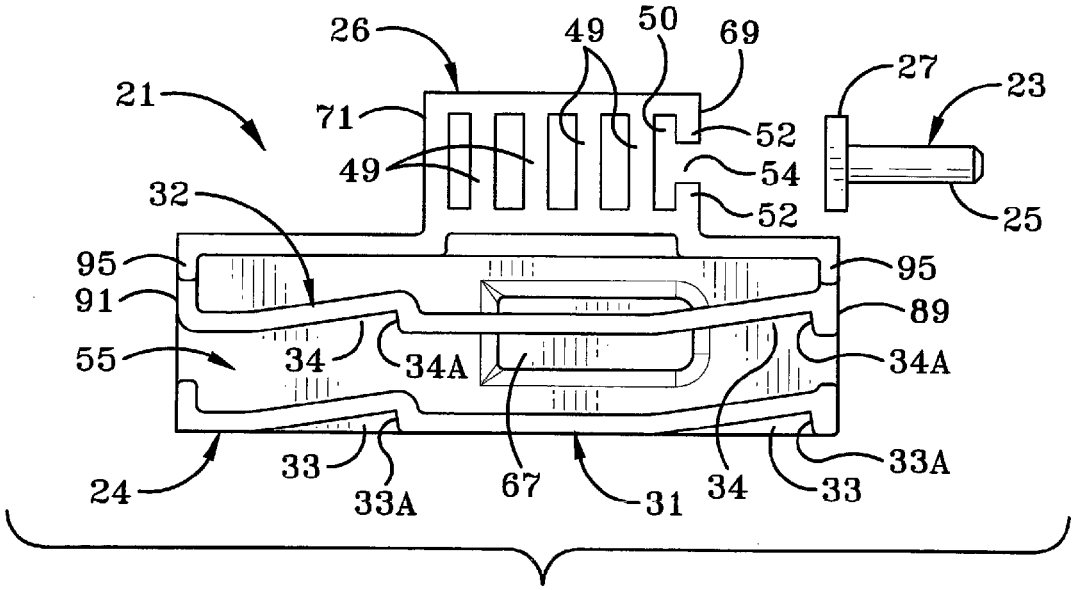
FIG. 5 is a bottom plan view of the slide element having a lock pin exploded therefrom.
Figure 7:
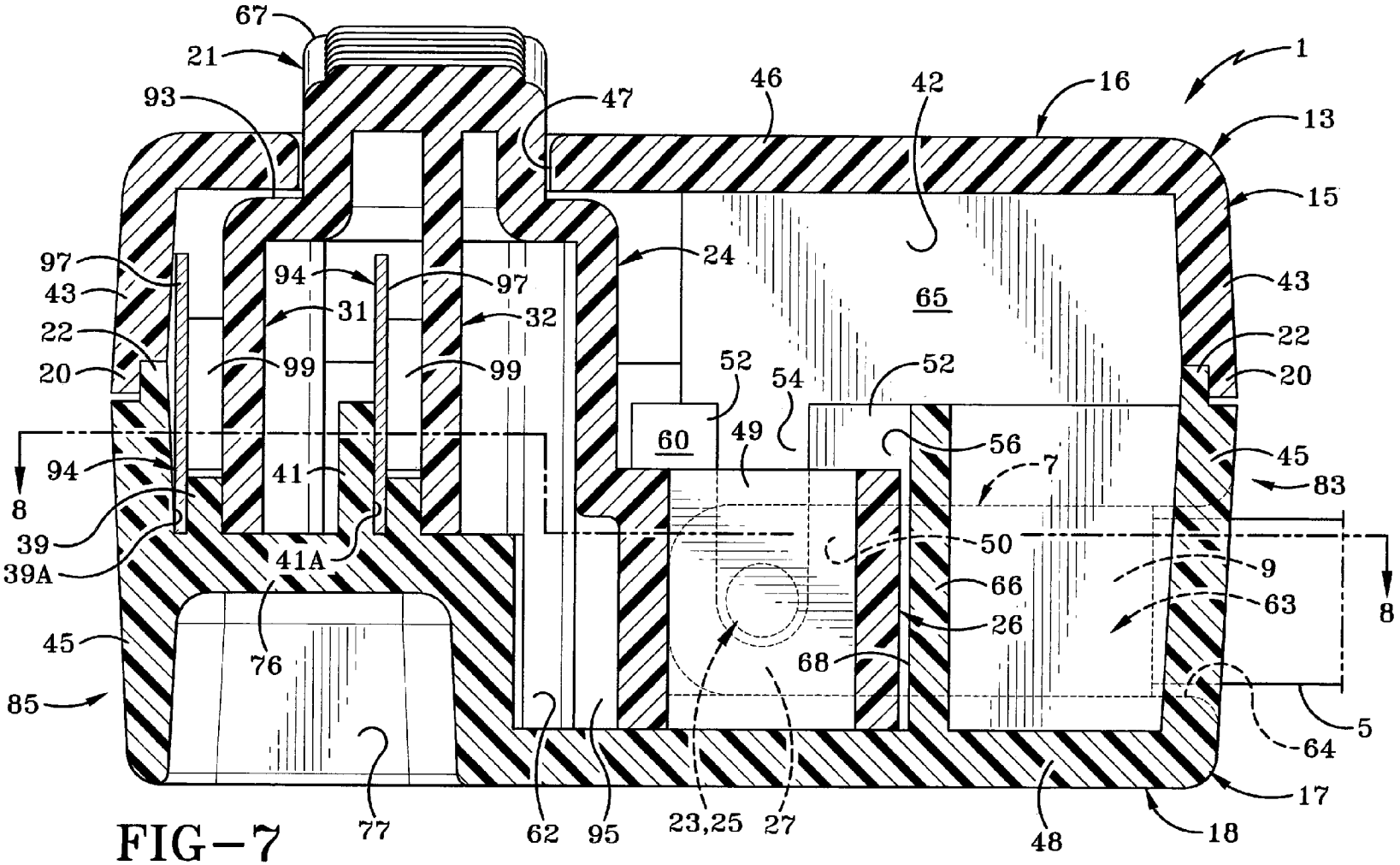
FIG. 7 is a cross-sectional view taken on line 7-7 of FIG. 1.

As shown in FIGS. 4 and 5, it is a primary feature of the present invention that a slide 21 is configured to fit between top portion 15 and bottom portion 17, and slidably move therein. Slide 21 includes a thumb portion 24 and a lock portion 26. Thumb portion 24 includes a thumb press 67 extending upwardly from a top surface 93. Thumb press 67 is sized to fit through opening 47 in top portion 15 and slide therein (FIG. 7). Thumb portion 24 extends from a front surface 89 to a rear surface 91. A first wall 31 and a second wall 32 extend generally from front surface 89 to rear surface 91 and define a slide channel 55 between, whereby first wall 31 is configured to define a pair of receiving features 33 each having a shoulder 33A and second wall 32 is configured to define a pair of receiving features 34 each having a shoulder 34A. A finger 95 extends downwardly and away from thumb press 67. Lock portion 26 extends from finger 95 and is formed in a generally rectangular block-like shape having a plurality of brace ribs 49 therein. A pocket 50 and channel 54 is formed and defined by a pair of fingers 52 extending to define pocket 50 and channel 54 in a general T-shape opening in lock portion 26. Pocket 50 is sized to receive a back plate 27 of a lock pin 23, wherein channel 54 is sized to allow a pin shaft 25 of lock pin 23 to pass therethrough, while retaining back plate 27 securely in pocket 50. Fingers 52 define a first surface 69, which is spaced apart and generally co-planer with a second surface 71.

Figure 8:
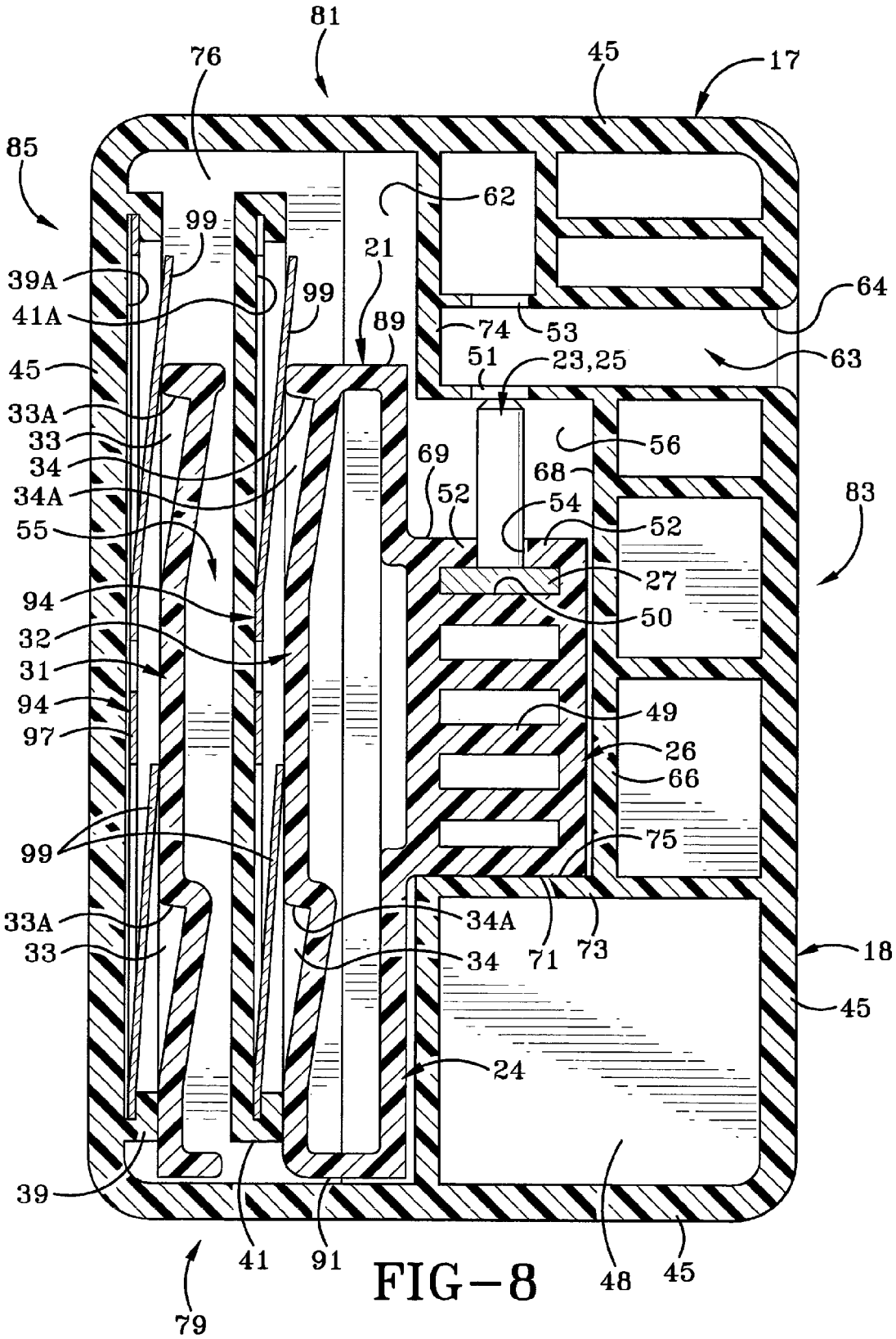
FIG. 8 is a cross-sectional view taken on line 8-8 of FIG. 7.

As shown in FIGS. 6-9, slide 21 is configured to slide within housing 13 between an unlocked position, as shown in FIG. 8, and a locked position, shown in FIG. 9. Multiple elements within slide 21, top portion 15, and bottom portion 17 act in concert to brace and facilitate this sliding movement. As shown in FIG. 7, finger 95 is sized to be complementarily received within finger recess 62, and be securely held therein during the movement of slide 21. Likewise, locking plate receiving element 41 complementarily fits in channel 55 formed between first wall 31 and second wall 32. Thumb press 67 fittably extends through opening 47 in top portion 15 and slide 21 is thus further stabilized by the restrictive size of opening 47 with respect to thumb press 67. Thus, slide 21 is sufficiently contained within housing 13 such that all movement is restricted, except for the desired movement between the locked and unlocked positions. This controlled sliding movement ensures that the longitudinal nature of pin shaft 25 is generally aligned with imaginary center line 87 extending through first bolt opening 51 and second bolt opening 53.

Figure 6:
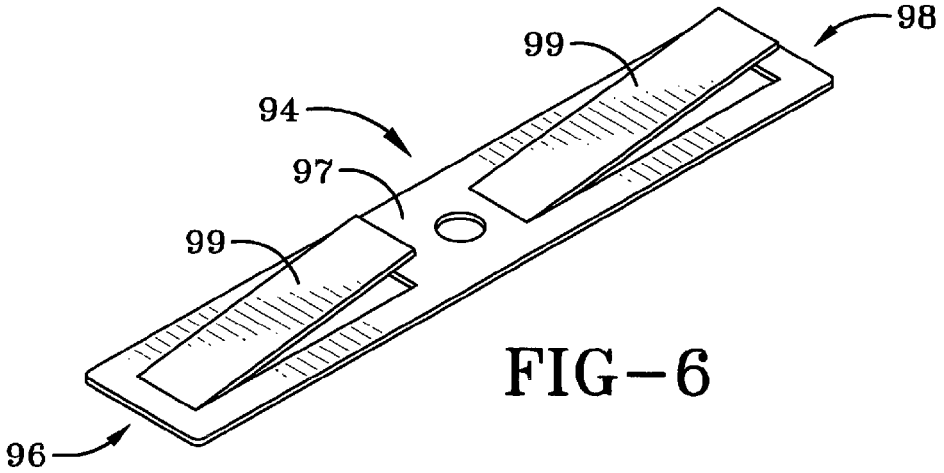
FIG. 6 is a perspective view of a locking plate used in the tether.

As shown in FIGS. 6 and 8, tether 1 includes a locking plate 94. Locking plate 94 includes a flat base 97 and a pair of locking members 99 that is biased to extend away from base 97 toward first wall 31, and in particular receiving features 33 when locking plate 94 is fitted into bottom portion 17. Locking plate 94 is sized to be received in either slot 39A or slot 41A, as desired by the manufacturer. The placement of locking plate receiving element 39 and locking plate receiving element 41 is such that a stronger magnetic key is required to unlock tether 1 when locking plate 94 is disposed in slot 41A, rather than slot 39A, as slot 41A is spaced farther from the exterior of tether 1, and more particularly spaced farther from top wall 46 where the magnetic key will be applied.

Locking members 99 extends from base 97 in an angled or tapered manner to allow first wall 31 to pass along the taper and force locking members 99 to recede against its bias towards base 97 as slide 21 moves within housing 13. Locking plate 94 includes a first end 96 and a spaced apart second end 98, and is sized and configured to be firmly and securely retained by slot 39A within locking plate receiving element 39 within housing 13 when first portion 15 is secured to second portion 17. The precise placement of slot 39A aligns locking members 99 proximate first wall 31 in general, and receiving features 33 in particular. Thus, when tether 1 is in the locked position locking members 99 extend into receiving features 33 and abut shoulders 33A to prevent tether 1 from moving to the unlocked position. Similarly, the precise placement of slot 41A aligns locking members 99 proximate second wall 32 in general, and receiving feathers 34 in particular. Thus, when tether is in the locked position, locking members 99 extend into receiving features 34 and abut shoulders 34A to prevent tether 1 from moving to the unlocked position.

As shown in FIG. 8, tether 1 is in the unlocked position with a locking plate 94 disposed in both slots 39A and 41A. Locking plate 94 is shown in both slots 39A and 41A for exemplary purposes only. In operation, locking plate 94 is disposed in only one of slots 39A and 41A. In the unlocked position, second surface 71 of lock portion 26 abuts back surface 75 of back wall 73 on lower portion 17. Conversely, first surface 69 of lock portion 26 is spaced apart from front surface 60 of first wall 59. Thus, shaft 25 of lock pin 23 does not extend through bolt opening 51 and bolt opening 53. The longitudinal nature of lock channel 63 is open and unobstructed by shaft 25. Likewise, locking members 99 are receded against their bias by way of first wall 31 or second wall 34 pressing against the outward bias of locking members 99 to push locking members 99 towards base 97. Receiving features 33 or receiving features 34, as desired, are unaligned with locking members 99 such that slide 21 is movable in the direction of Arrow A (FIG. 9) within housing 13 into the locked position.

Figure 15:
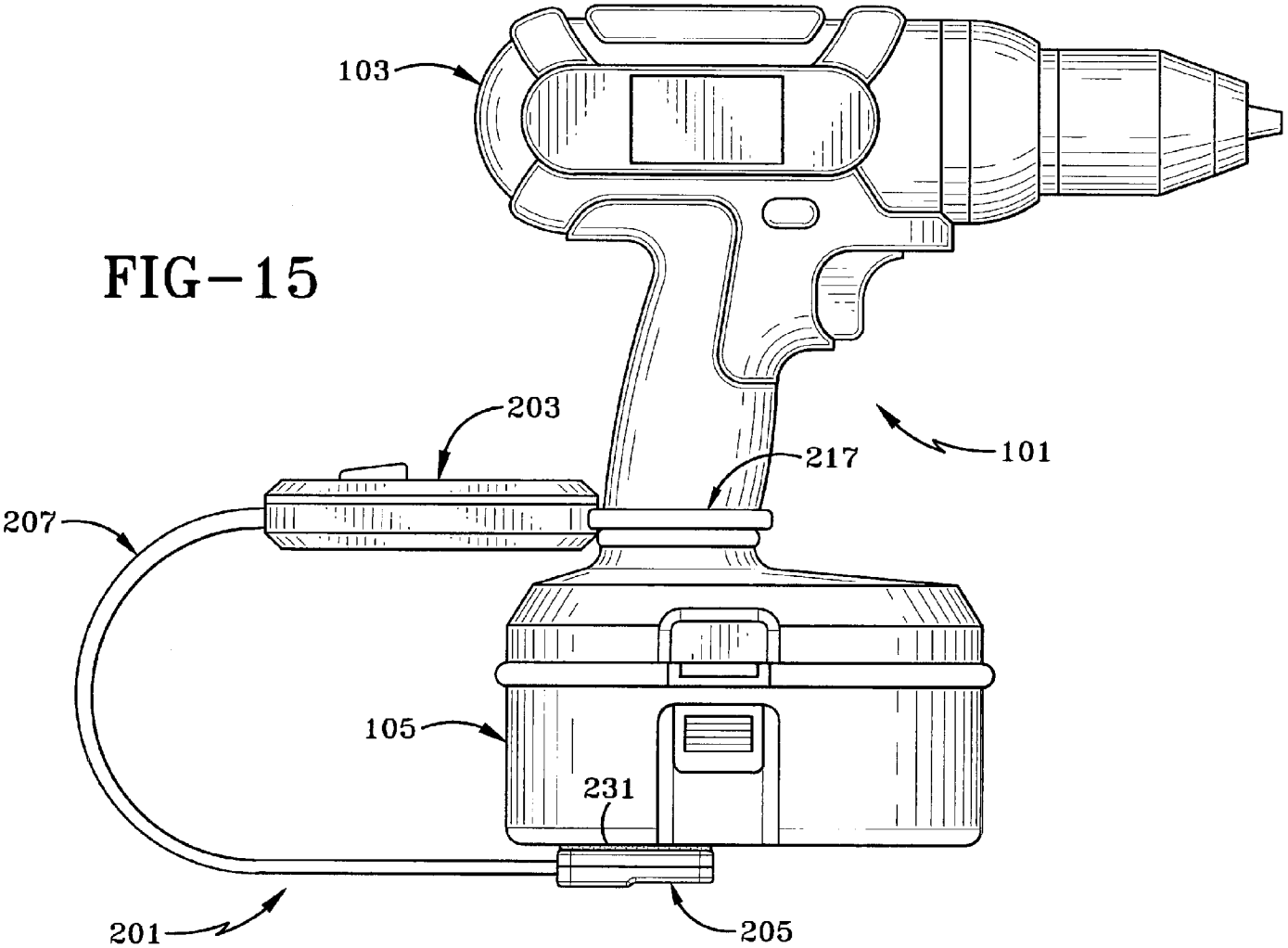
FIG. 15 is a side elevational view of the security device engaged with and securing the two main portions of a cordless drill.

As shown in FIG. 9, tether 1 is in the locked position. In the locked position, second surface 71 of lock portion 26 is spaced apart from back surface 75 of back wall 73 on lower portion 17. Conversely, first surface 69 of lock portion 26 abuts front surface 60 of first wall 59. As a result, shaft 25 of lock pin 23 extends through both bolt opening 51 and bolt opening 53, perpendicularly disrupting the longitudinal nature of lock channel 63. As receiving features 33 or receiving features 34 move into alignment with locking members 99, the outward bias on locking members 99 moves each locking member 99 into the corresponding receiving feature 33 or 34 as first wall 31 and second wall 34 moves in the direction of Arrow A. As shown in FIG. 15, locking members 99 fit securely into receiving features 33 or receiving features 34, as desired, when tether 1 is in the locked position, and thereby prevents movement of slide 21 in the direction opposite Arrow A.

As shown in FIG. 10, free end 7 of cable 5 may be inserted into lock channel 63 by a user to secure cable 5 to tether 1. Lock channel 63 is sized and configured to fittingly receive free end 7 of cable 5 therein, thereby positioning crimp 9 proximate first bolt opening 51, second bolt opening 53, and wall 74. When free end 7 is inserted into tether 1, and tether 1 is in the locked position, shaft 25 extends through lock hole 8 in free end 7 of cable 5. This firmly secures cable 5 to tether 1 as free end 7 cannot be removed from lock channel 63 without first retracting shaft 25 by way of slide 21. Inasmuch as slide 21 is locked in this position by way of locking members 99 engaged with receiving features 33 or receiving features 34, as desired, shaft 25 cannot be removed from lock hole 8 without first overcoming the bias of locking members 99. This is accomplished by way of a magnetic key (not shown), such that the key is positioned to actuate the magnetically attractable locking members 99.

Referring particularly to FIGS. 1, 2, 6, 8, and 9, as discussed previously, top portion 15 includes outer surface 16 having depressions 57 therein (FIG. 1). Depressions 57 are positioned on outer surface 16 such that they align with locking members 99 within housing 13. Thus, a user positioned magnetic key by way of depressions 57 to align magnets internal to the key with locking members 99. This magnetically actuates locking members 99 to overcome the spring bias and sufficiently retract locking members 99 out of receiving features 33 or receiving features 34, as desired, and towards plate 94. As such, slide 21 may be manually moved in the direction opposite Arrow A (FIG. 9) as locking members 99 no longer prevent this movement. As tether 1 is moved from the locked to the unlocked position, shaft 25 is retracted from hole 8 and lock pin 23 is disengaged with free end 7 of cable 5. Thus, cable 5 may be removed from tether 1 only after a magnetic key retracts locking members 99.

Figure 12:
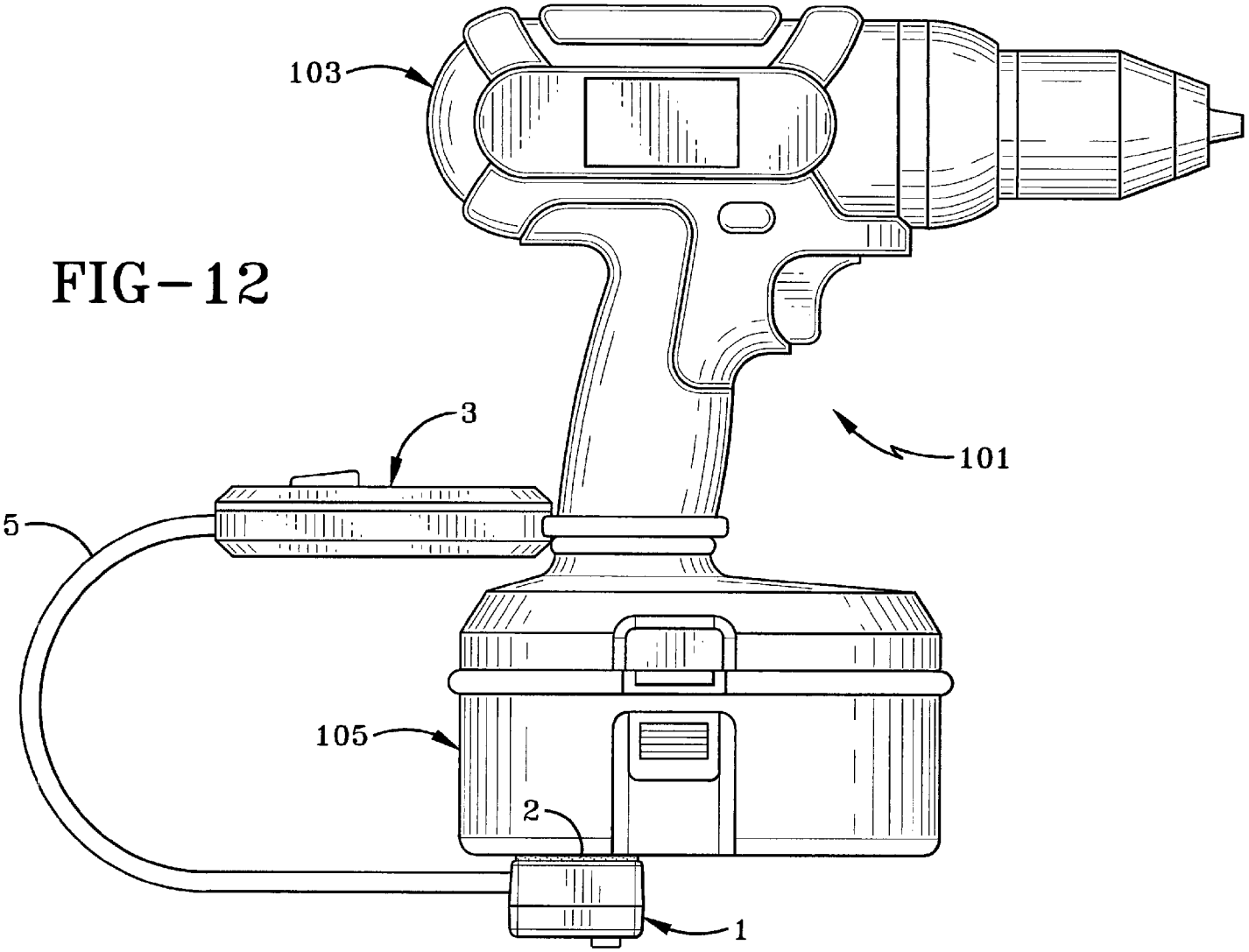
FIG. 12 is a side elevational view of the security device engaged with and securing the two main portions of a cordless drill.

In operation, as shown in FIG. 12, security tether 1 is used in conjunction with cable lock security device 3 to secure an article of goods 101 comprised of a first separate part 103 and a second separate part 105. It is the primary feature of this invention that parts 103 and 105 may be separated and stolen by a shoplifter, as each part 103 and 105 separately have value. As shown in FIG. 12, article 101 is shown as a cordless drill having drill portion 103 and battery portion 105. It is the primary feature of the invention that security tether 1 is used in conjunction with cable lock security device 3 to secure battery 105 or drill 103 together to prevent these items from being separately stolen.

As shown in FIG. 12 and commonly known in the art, cable lock security device 3 is secured to a portion of 103, whereby free end 7 of cable 5 extends away from drill portion 103. When a user wishes to secure battery portion 105, outer surface 18 of bottom portion 17 of security tether 1 is secured to battery 105. In a preferred embodiment, security tether 1 is permanently adhered using an adhesive layer 2 to battery 105, though it is envisioned that tether 1 may be screwed onto battery 105 or secured using any commonly used methods in the art. At this stage, tether 1 is in the unlocked position. Once security tether 1 is sufficiently secured to battery portion 105, the user positions free end 7 of cable 5 such that free end 7 enters opening 64 and plunges into lock channel 63.

Free end 7 is inserted into lock channel 63 such that lock hole 8 extending through crimp 9 is generally aligned with first bolt opening 51 and second bolt opening 53. The user then manually actuates thumb press 67 to move slide 21 in the direction of Arrow A (FIG. 9). This moves security tether 1 from the unlocked position to the locked position as slide 21 moves such that locking members 99 of locking plate 94 align with receiving features 33 of first wall 31 or receiving features 34 of second wall 32. When locking members 99 are aligned with receiving features 33, locking members 99 extend into receiving features 33 such that slide 21 cannot be manually moved in the direction opposite Arrow A (FIG. 9), as locking members 99 prevent this movement, rendering security tether 1 in the locked position. Concurrently, as slide 21 moves in the direction of Arrow A (FIG. 9), lock portion 26 moves to thereby move lock pin 23 such that shaft 25 enters lock hole 8 proximate first bolt opening 51, extending all of the way through free end 7, and out lock hole 8 proximate second bolt opening 53. As such, free end 7 of cable 5 is thereby locked within lock channel 63 such that cable 5 may only be removed from security tether 1 by moving slide 21 such that shaft 25 is retracted from lock hole 8. However, as discussed previously, locking members 99 prevent such movement due to the firm abutment between locking members 99 and shoulders 33A or 34A. Thus, cable lock security device 3 is secured to drill portion 103, tether 1 is secured to battery portion 105, and cable lock security device 3 is firmly secured to security tether 1 by way of cable 5. As such, the two separate pieces of device 101, namely 103 and 105, cannot be separately stolen.

When the user wishes to remove cable 5 from the locking engagement with security tether 1, a magnetic key is placed proximate security tether 1. Specifically, it is envisioned that the magnetic key will include at least two magnets strong enough to actuate locking members 99 through housing 13, whether lock plate 94 is disposed in slot 39A or 41A, as desired by the user. The magnetic key is generally aligned by way of depressions 57 (FIG. 1) such that each magnet aligns with each locking member 99. The magnetic attraction between the magnets and locking members 99 result in locking members 99 overcoming their outward bias such that each locking member 99 retracts out of receiving features 33 or receiving features 34 towards locking plate 94. As such, slide 21 is free to slide in the opposite direction of Arrow A (FIG. 9) by way of a user pressing thumb press 67 in this direction. This results in security tether 1 being moved from the locked position to the unlocked position, thereby retracting shaft 25 from the locked engagement with free end 7 of cable 5, and removing shaft 25 from lock hole 8. The user then removes cable 5 from lock channel 63 to disconnect cable lock security device 3 from security tether 1.

Security tether 1 provides a method of securing battery 105 and thwarting attempts to remove battery 105 from drill 103 for theft by way of sense loop or sense circuit provided by cable 5 and extending from tether 1 to cable lock 3. As shown in FIG. 10, leads 11 extend into crimp 9 and are positioned separate from one another as lead 11A and lead 11B with a space therebetween. Further, leads 11A and 11B are exposed in lock hole 8, such that when this space is filled by shaft 25 of lock pin 23, the circuit is completed and lead 11A is electrically connected to lead 11B by way of shaft 25. This sense loop or sense circuit is monitored by an internal security system of cable lock 3, and an audible alarm is emitted when the sense loop is broken. As commonly known in the art, cable locks such as cable lock 3 typically include proper alarm logic and circuitry to arm an alarm system when the cable lock is in a locked position. Thus, it is a primary feature of the present invention that cable lock 3 includes proper alarm logic for arming and disarming an alarm system, whereas the alarm system monitors the sense loop provided through cable 5 and completed by lock pin 23 when tether 1 is in the locked position. Pursuant to this, when a thief cuts cable 5, the sense loop is broken and an audible alarm is emitted from cable lock 3. Further, if a thief attempts to pull cable 5 out of the locking engagement with tether 1, crimp 9 remains locked with tether 1 while cable 5 and leads 11A and 11B are removed from channel 63. This removes leads 11A and 11B from shaft 25, thereby breaking the sense circuit and triggering the alarm system of cable lock 3.

Figure 13:
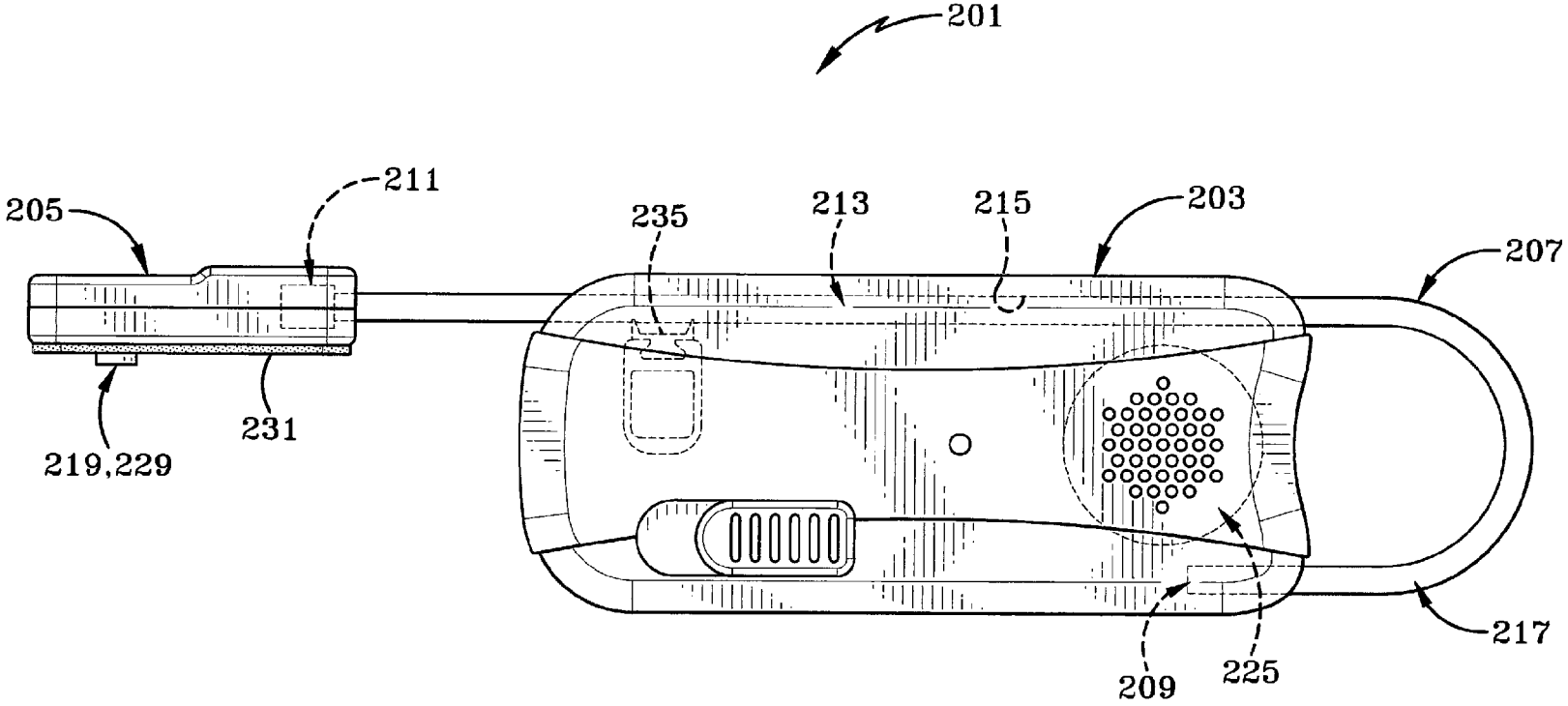
FIG. 13 is a side elevational view of a second embodiment of the security device of the present invention showing a first housing connected to a second housing by a cable.
Figure 14:
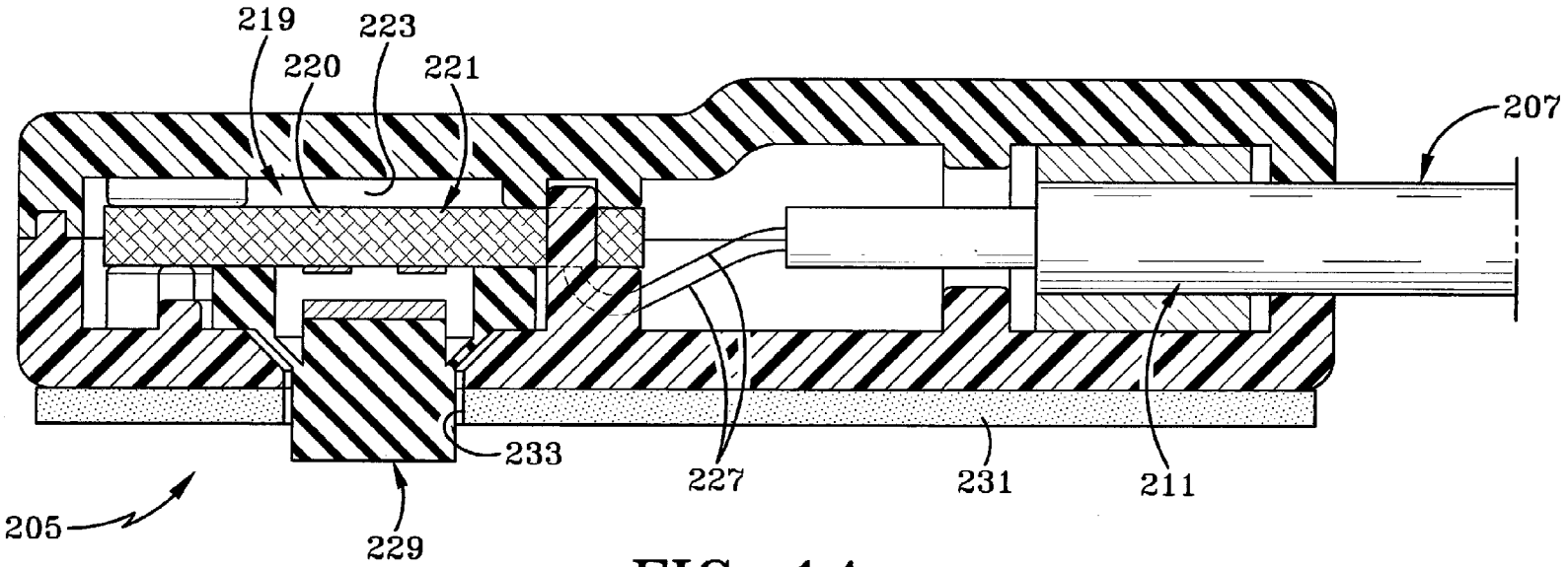
FIG. 14 is a cross-sectional view of the second housing.

A second embodiment of the security device of the present invention is indicated generally at 201 in FIG. 13-15 and is comprised of a first housing 203 and a second housing 205. As shown in FIGS. 13 and 15, device 201 is shown secured on the previously described article of goods, which in this example takes the form of a drill 101 with main drill body 103 and drill battery 105. First housing 203 is secured to main drill body 103 and second housing 205 is secured to drill battery 105. Security device 201 includes a cable 207 having a first end 209 secured to first housing 203 and a second end 211 secured to second housing 205. Cable 207 extends outwardly away from first housing 203 and loops back to dispose an intermediate portion 213 of cable 207 through a channel 215 defined by first housing 203, thereby forming an adjustable loop 217 for use in attaching first housing 203 to drill body 103.

Referring to FIG. 14, second housing 205 includes a removal sensor 219 for sensing when second housing 205 is in an attached position or a removed position with respect to an article of goods, shown here as drill battery 105. Removal sensor 219 is shown in FIGS. 13-15 as a plunger switch style of sensor. However, it will be readily understood that any style of removal sensor may be used in second housing 205 for sensing when second housing 205 moves from the attached position to the removed position.

Removal sensor 219 includes a body 220 for holding a simple electrical switch 221. Switch 221 is electrically coupled with an alarm system 225 disposed in first housing 203 by way of a pair of electrical wires 227 extending through cable 207 from first housing 203 to second housing 205 and into alarm system 225. Switch 221 is further electrically coupled with a plunger 229 biased to extend outwardly away from switch 221 through an opening 230 defined by second housing 205. As commonly understood in the art, plunger 229 mechanically opens or closes switch 221 through physical movement of plunger 229.

Second housing 205 defines an interior chamber 223 configured to receive body 220. Inasmuch as second housing 205 is secured to drill battery 105 by way of an adhesive pad 231 in the exemplary embodiment, adhesive pad 231 includes a corresponding opening 233 to allow plunger 229 to extend therethrough and contact drill battery 105. Interior chamber 223 is also configured to receive other related structures such as an electronic article surveillance (EAS) tag. Use of an EAS tag may allow for the sounding of an alarm other than that included in alarm system 225 should alarm system 225 become non-functional.

Referring to FIG. 14, plunger 229 is shown in an extended, non-depressed position associated with second housing 205 being removed from drill battery 105, wherein second housing 205 is referenced as being in the removed position. In the non-depressed position, plunger 229 opens switch 221. As shown in FIG. 15, plunger 229 is shown in the depressed position associated with second housing 205 being attached to drill battery 105, wherein second housing 205 is referenced as being in the attached position. In the depressed position, plunger 229 completes or closes switch 221.

Wires 227 provide respective electrical communication between removal sensor 219 and alarm system 225 to form an electrical sense circuit which is either closed or open when plunger 229 is depressed or non-depressed, respectively. More particularly, when plunger 229 is in the depressed position associated with second housing 205 being in the attached position, alarm system 225 will not sound an alarm as sense circuit is closed and energized to electrically indicate that the integrity of the attachment between second housing 205 and drill battery 105 is maintained. When plunger 229 is in the extended or removed position, alarm system 225 is alerted by way of switch 221 opening and de-energizing the sense circuit extending from second housing 205 to first housing 203.

Alarm system 225 is changeable between an armed state and an unarmed state, as desired by the user. Alarm system 225 includes a lock 235 movable to a locked position for locking intermediate portion 213 in channel 215 to hold loop 217 in a fixed size to secure first housing 203 to drill body 103. Lock 235 is operably connected to alarm system 225 to move alarm system to the armed state when lock 235 is moved to the locked position. Alarm system 225 does not sound an alarm in the unarmed state, regardless of the position of plunger 229. Thus, second housing 205 must first be secured to drill battery 105 to energize the sense circuit before lock 235 is moved to the locked position and alarm system 225 is moved to the armed state.

In the exemplary embodiment, there is no locking mechanism for locking second housing 205 to drill battery 105 and thus no key for removal thereof. Thus, while second housing 205 may be pried off drill battery 105 with some difficulty, the result is the sounding of an alarm associated with alarm system 225.

One of the primary features of the present invention is the self-contained nature of security device 201. One will readily recognize the user may physically move drill 101 anywhere in the store to view or use drill 101 and contemplate purchasing said item. Prior art security devices are wired into a central control unit or base station, severely limiting the range a user can move the item. Thus, security device 201 is free of a base state or other central control unit. Inasmuch as the only lanyard or cable required by security device 201 is cable 207, which extends between first housing 203 and second housing 205, the overall distance drill 101 may be moved is unlimited. As alarm system 225 is disposed in first housing 203, and removal sensor 219 is disposed in second housing 205, security device 201 travels with the item for protection. This increases the usability of the item while maintaining security thereof.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A security device comprising:

a first housing adapted to be secured to a first article;

a first lock system disposed in the first housing and movable between a first lock system locked state and a first lock system unlocked state via a magnetic key;

a second housing adapted to be secured to a second article;

a second lock system disposed within the second housing, wherein the second lock system comprises:

(1) a wall member positioned within the second housing, wherein the wall member includes a flat longitudinal surface and a shoulder portion biased substantially perpendicular to the flat longitudinal surface, and (2) a locking plate having a flat base and a locking member, the locking plate alterable between a locking plate locked state and a locking plate unlocked state, wherein the locking member is configured to extend away from the flat base and engage the shoulder portion when the locking plate is in the locking plate locked state;

a cable for connecting the first housing and the second housing, wherein the cable includes a first end, a second end, and an intermediate portion movably disposed in a channel defined by the first housing;

an adjustable loop formed by the cable for securing the first housing to the first article, wherein the loop extends between the first end and the intermediate portion of the cable; and an alarm system movable between an armed state when the first lock system is in the first lock system locked state and an unarmed state when the first lock system is in the first lock system unlocked state;

wherein the alarm system is configured to emanate an audible alarm when the alarm system is in the armed state and the second housing is not secured to the second article;

wherein the intermediate portion is immovable in the channel when the first lock system is in the first lock system locked state, the intermediate portion is movable in the channel when the first lock system is in the first lock system unlocked state, and the intermediate portion is prevented from moving in the channel when the alarm system is in the armed state.

2. The security device of claim 1, wherein the locking plate is fixed relative to the second housing.

3. The security device of claim 1, wherein the locking member does not engage the shoulder portion when the locking plate is in the locking plate unlocked state.

4. The security device of claim 3, further comprising a sensor operably connected to the alarm system, wherein the sensor is configured to detect when the second housing is not secured to the second article.

5. The security device of claim 4, wherein the sensor is disposed in the second housing and electrically coupled with the alarm system through the cable.

6. The security device of claim 5, wherein the sensor includes a plunger switch for sensing the removal of the second housing from the second article.

7. A security device comprising:

a first housing adapted to be secured to a first article;

a first lock system disposed in the first housing and movable between a first lock system locked state and a first lock system unlocked state;

a second housing adapted to be secured to a second article;

a second lock system disposed within the second housing, wherein the second lock system comprises:

(1) a wall member positioned within the second housing, wherein the wall member includes a flat longitudinal surface and a shoulder portion biased substantially perpendicular to the flat longitudinal surface, and (2) a locking plate having a flat base and a locking member, the locking plate alterable between a locking plate locked state and a locking plate unlocked state, wherein the locking member is configured to extend away from the flat base and engage the shoulder portion when the locking plate is in the locking plate locked state;

a cable for connecting the first housing and the second housing, wherein the cable includes a first end, a second end, and an intermediate portion movably disposed in a channel defined by the first housing;

an adjustable loop formed by the cable for securing the first housing to the first article, wherein the loop extends between the first end and the intermediate portion of the cable;

an alarm system movable between an armed state and an unarmed state, wherein the alarm system is configured to emanate an audible alarm when the alarm system is in the armed state and the second housing is not secured to the second article; and a magnetic key;

wherein the intermediate portion is prevented from moving in the channel when the alarm system is in the armed state;

wherein the intermediate portion is immovable in the channel when the first lock system is in the first lock system locked state and the intermediate portion is movable in the channel when the first lock system is in the first lock system unlocked state;

wherein the alarm system is in the armed state when the first lock system is in the first lock system locked state and the alarm system is in the unarmed state when the first lock system is in the first lock system unlocked state; and wherein the first lock system is movable from the first lock system locked state to the first lock system unlocked state by the magnetic key.

8. The security device of claim 7, further comprising a sensor operably connected to the alarm system, wherein the sensor is configured to detect when the second housing is not secured to the second article.

9. A security device comprising:

a first housing adapted to be secured to a first article;

a first lock system disposed in the first housing and movable between a first lock system locked state and a first lock system unlocked state;

a second housing adapted to be secured to a second article;

a second lock system disposed within the second housing, wherein the second lock system comprises:

(1) a wall member positioned within the second housing, wherein the wall member includes a flat longitudinal surface and a shoulder portion biased substantially perpendicular to the flat longitudinal surface, and (2) a locking plate having a flat base and a locking member, wherein the locking member is configured to extend away from the flat base and engage the shoulder portion when the locking plate is in a locking plate locked state;

a cable for connecting the first housing and the second housing, wherein the cable includes a first end, a second end, and an intermediate portion movably disposed in a channel defined by the first housing;

an adjustable loop formed by the cable for securing the first housing to the first article, wherein the loop extends between the first end and the intermediate portion of the cable;

an alarm system movable between an armed state and an unarmed state, wherein the alarm system is configured to emanate an audible alarm when the alarm system is in the armed state and the second housing is not secured to the second end of the cable; and a magnetic key;

wherein the second lock system is movable between a second lock system unlocked state and a second lock system locked state for selectively locking the second end of the cable to the second housing; and wherein the second lock system is movable from the second lock system locked state to the second lock system unlocked state by the magnetic key.

10. The security device of claim 9, further comprising a sensor operably connected to the alarm system, wherein the sensor is configured to detect when the second housing is not secured to the second article.

11. A security device comprising:

a first housing adapted to be secured to a first article;

a second housing adapted to be secured to a second article;

a cable configured to connect the first housing and the second housing, the cable including a first end connected to the first housing, a second end comprising a lock hole, and an intermediate portion disposed in a channel defined by the first housing;

an alarm system having an armed state and an unarmed state, the alarm system comprising a sense circuit;

a first lead and a second lead exposed in the lock hole;

a first lock system disposed in the first housing, the first lock system alterable between: (a) a first lock system locked state in which the intermediate portion of the cable is locked to the first housing; and (b) a first lock system unlocked state in which the intermediate portion of the cable is unlocked from the first housing; and a second lock system disposed within the second housing, the second lock system comprising a lock pin and alterable between: (a) a second lock system locked state in which the second end of the cable is locked to the second housing; and (b) a second lock system unlocked state in which the second end of the cable is unlocked from the second housing so as to be removable from the second housing;

wherein when the second lock system is in the second lock system locked state, the lock pin (1) extends through the lock hole, thereby locking the second end of the cable to the second housing, and (2) electrically connects the first lead to the second lead, thereby completing the sense circuit;

wherein when the second lock system is in the second lock system unlocked state, the lock pin is retracted from the lock hole, thereby allowing the second end of the cable to be removed from the second housing; and wherein, when the alarm system is in the armed state and the sense circuit is broken, the alarm system causes an alarm.

12. The security device of claim 11, wherein the first lock system is alterable between the first lock system locked state and the first lock system unlocked state by a magnetic key.

13. The security device of claim 11, further comprising a sensor operably connected to the alarm system, wherein the sensor is configured to detect when the second housing is not secured to the second article.

14. The security device of claim 13, wherein the sensor is disposed in the second housing and electrically coupled with the alarm system through the cable.

15. The security device of claim 13, wherein the sensor includes a plunger switch for sensing the removal of the second housing from the second article.

* * * * *